United States Patent [19]

Michaux

[11] 4,370,877

[45] Feb. 1, 1983

[54] ROLLING MILL ROLLS

[75] Inventor: Jacques M. Michaux, Joeuf, France

[73] Assignee: Sacilor-Acieries et Laminoirs de Lorraine, Hayange, France

[21] Appl. No.: 176,678

[22] Filed: Aug. 11, 1980

[30] Foreign Application Priority Data

Feb. 4, 1980 [FR] France ..... 80 02382

[51] Int. Cl.[3] ..... B21B 39/16; B21B 39/18

[52] U.S. Cl. ..... 72/222; 72/225; 72/228; 72/229; 72/250; 72/366

[58] Field of Search ..... 72/221, 222, 226, 227, 72/228, 229, 231, 233, 234, 250, 366

[56] References Cited

U.S. PATENT DOCUMENTS

| | | | |
|---|---|---|---|
| 341,570 | 5/1886 | Graham | 72/221 |
| 525,207 | 8/1894 | Hemphill et al. | 72/229 |
| 1,228,782 | 6/1914 | Kernohan et al. | 72/229 |
| 3,165,948 | 1/1965 | Kishikawa | 80/66 |
| 3,342,053 | 9/1967 | Stammbach | 72/226 |
| 3,657,912 | 4/1972 | Ishibashi et al. | 72/234 |

FOREIGN PATENT DOCUMENTS

| | | | |
|---|---|---|---|
| 1012887 | 8/1957 | Fed. Rep. of Germany . | |
| 567047 | 2/1924 | France . | |
| 577293 | 9/1924 | France | 72/231 |

*Primary Examiner*—Francis S. Husar
*Assistant Examiner*—Jonathan L. Scherer
*Attorney, Agent, or Firm*—Schroeder, Siegfried, Vidas, Steffey & Arrett

[57] ABSTRACT

Rolling mill rolls having open grooves comprising active and relatively non-active portions are provided wherein at least two such grooves are overlapped by their relatively non-active portions. Also disclosed are processes for feeding such rolls, a stand connecting such rolls and a universal rolling mill having stands incorporating such rolls.

5 Claims, 16 Drawing Figures

1
2
6
3
5
13
14
12
4
A
7
13
14
12
8
B
11
9
13
14
12
10
C
13
7'
13
14
12
8'
14
12
B'

ROLLING MILL ROLLS

This invention, applicable to the rolling of sections such as rails, beams, channels or sheeting piles, relates to the arrangement of open grooves on the horizontal rolls of edger or similar stands, particularly of universal rail rolling mills. The invention also relates to rolling mill equipment such as stands, rolls and guides.

BACKGROUND OF THE INVENTION

As is known, a groove is called rolling (or open) when its joints are parallel to the longitudinal axis of the rolls or when the angle formed by the joints and the longitudinal axis of the rolls is less than 60°. The passage of a bar in a groove is called a pass when a rolling action is exerted on the bar via all or part of the groove contour. In the present application, a groove will be called specific when its contours and dimensions are well adapted to the pass which is made therein.

To arrange side by side, separately, in conventional rolling, similar or different specific grooves on the rolls of two-high or three-high stands, belongs to the state of the art of rolling since the 18th century.

It is known, for reversing two-high edger stands of a universal beam rolling mill, to vary the dimensions of a single groove in a vertical direction by raising or screw-down of the rolls, that is to say by varying the spacing of the rolls. This method is disclosed, among others, for the rolling of beams, by U.S. Pat. No. 1,812,246 dated June, 30, 1931.

It is known from French Pat. No. 1,298,605, dated Aug. 3, 1961 and relating to a reversing two-high edger stand of a universal beam rolling mill, to use a technique consisting of shifting the edger rolls perpendicularly to the rolling line, to bring in turn into the rolling line at least two separate specific edging grooves, similar or different, said grooves (known per se) being arranged side by side on the rolls.

From French Pat. No. 1,447,939, corresponding to U.S. Pat. No. 3,342,053, dated June 27, 1966 is known a process for universal rolling of rails, in which the rail is rolled in universal stands and two-high edger stands. In this process the edging passes are carried out in reversible or non-reversible stands comprising a single groove. In the reversing edger stands, the dimensions of the single groove are modified in the vertical direction by raising or screw-down of the rolls. In the non-reversing edger stands each groove is specific.

Also known from French Pat. No. 69.42489 dated Dec. 9, 1969 published under No. 2.025.705, corresponding to U.S. Pat. No. 3,657,912, is the application to edging passes of universal rolled rails, of the technique revealed in French Pat. 1.298.605, corresponding to U.S. Pat. No. 3,165,948, for the edging of universal rolled beams, namely the shifting, during rolling of a rail, of the edging stand perpendicularly to the rolling line in order to bring in turn into the rolling line at least two specific edging grooves, either similar or different, arranged on the rolls (known per se) side by side and separated.

To arrange a plurality of grooves side by side but separated, according to the known state of the art, needs rolls of barrel length necessarily greater than the sum of the widths of the grooves. Such a length of barrel involves the rolls being heavy and therefore relatively costly. In the case of rolling mills whose stands are arranged as close as possible behind each other on the same roller table (line), for obvious economic reasons, the only known means for bringing a rail, for example, into the proper specific edging groove without causing detrimental damage to the same, consists of shifting the edger stand or its rolls perpendicularly to the rolling line. The extent of and the speed necessary for this displacement make such a stand costly to purchase, install and operate. Its intricacy also makes it more prone to breakdown.

SUMMARY OF THE INVENTION

The purpose of the invention, in the case of open grooves of which only part of the contours exerts a rolling action, is to reduce these disadvantages and:

by better utilization of the barrel length of the rolls, to reduce the weight and the cost of the latter, to arrange on the rolls a greater number of open grooves, preferably specific, to do away with the need to render the edger stands shiftable, or at least to lessen their shifting by an amount such as will minimize the intricacy and the resultant cost.

Said purpose is achieved by the following aspects of the invention:

the arrangement, on the rolls of a section rolling mill, of open grooves comprising active portions and relatively non-active portions, of several grooves overlapped by their relatively non-active portions, said grooves being overlapped to such an extent that the resulting overlapped region is common to several grooves;

the use of a stand whose rolls comprise at least two overlapping grooves;

the use of a rolling mill including at least one edger stand whose rolls comprise overlapped grooves.

the overlapped grooves of the invention can be of same and/or different contours. Several separate groups of overlapping grooves may be arranged advantageously on the rolls, the overlapping grooves of each group being positioned preferably in such a way that the common resulting overlapped region has the maximum possible width;

one or more separate grooves may also be arranged on the rolls comprising at least one group of overlapped grooves.

the application of a stand of the invention to a continuous or reversing rolling mill, for sections such as rails, said mill comprising universal stands and at least one edging stand of the invention.

In making it possible to increase the number of edging or forming passes exactly adjusted (to the contour portions to be rolled) to follow the forms of the passes which precede them, by a better utilization of the available barrel lengths on the rolls, the invention makes it possible when applied:

(A) On a reversing or continuous rolling mill:

to reduce the roll consumption by better utilization of the available barrel lengths of the rolls;

to reduce the necessary stock of rolls, making it possible to arrange on one same set of rolls spare passes of a same profile, passes of different profiles or a mixture of passes of different profiles along with spare passes;

consequently to reduce appreciably the labour costs of taking down and reassembling the stands to which the invention is applied;

increase the rolling mill production capacity by a reduction of the down-time for replacing rolls in cases where the grooves are worn or for a change of profile to be rolled;

reduce the costs and time of roll turning as the parts common to a plurality of passes are turned only once;

reduce the times and costs of handling the rolls between the storage areas, the rolling mill and the roll shop;

change from a programme of universal rail rolling to a programme of universal rolling of beams, channels, sheet piles or other similar profiles, or, without change of profile to roll a similar profile but of different dimensions, without it always being necessary to change the rolls of the two-high edger or forming stands.

(B) On a reversing rolling mill:

to increase the number of specific edging or shaping passes, exactly adapted to the previous pass, without multiplication of the number of stands or very expensive modifications of the stands or of the rolling mill;

for universal rolling of the beams and channels, to render the profile symmetrical.

The object of this invention will be better understood from the following description, from that of the state of the art, from a number of embodiments according to the invention, the whole being illustrated by the appended drawings in which:

DETAILED DESCRIPTION OF THE PREFERRED EMBODIMENTS

To facilitate understanding of the invention, avoiding superfluous repetition and too complex description intended to cover all the possible cases of application, the invention will be described essentially in its application to universal rail rolling.

Figure 1:
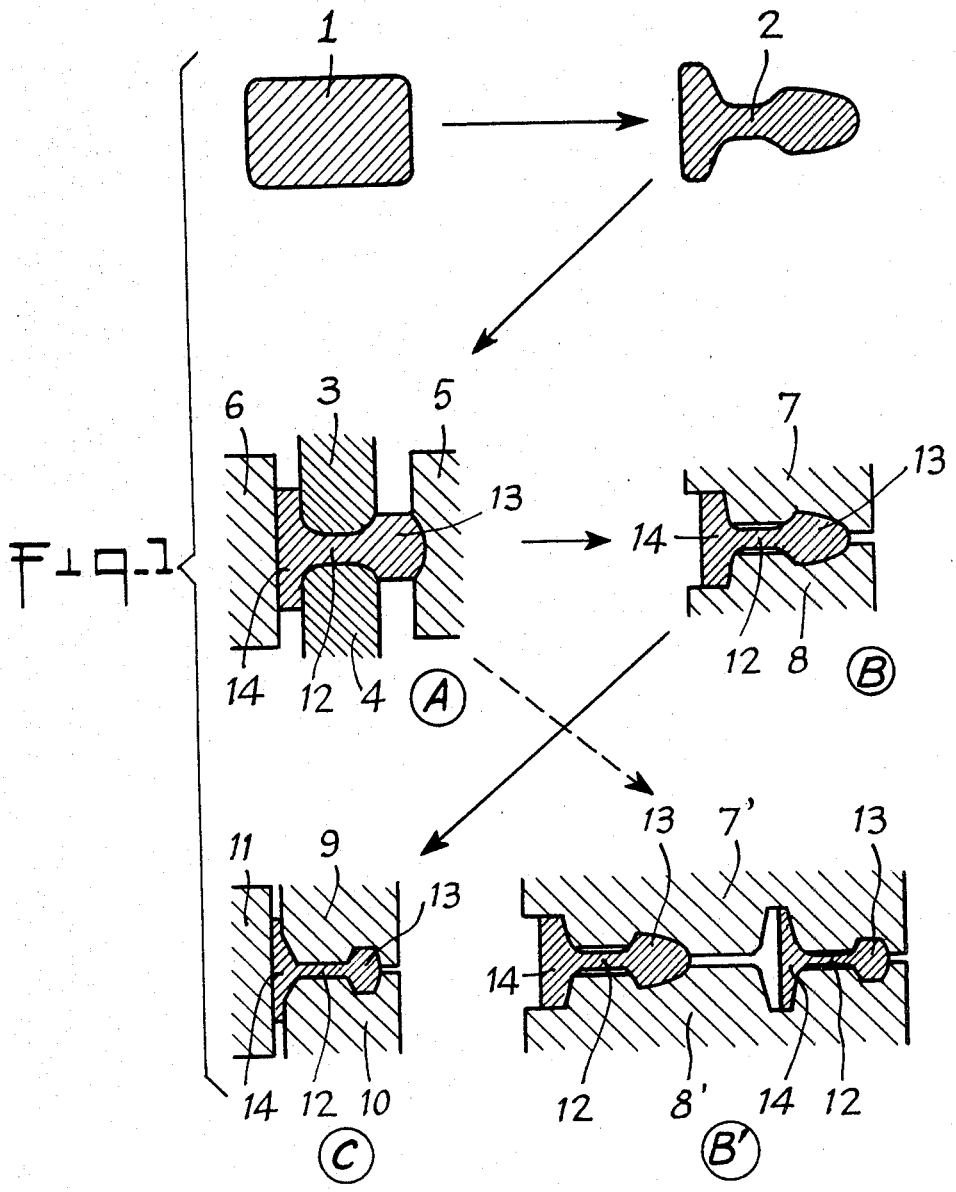
FIG. 1: represents diagrammatically the different phases of the previous art of universal rail rolling.

In the state of the art, that is to say in the universal rail rolling process of French Pat. No. 1.447.939 as shown in FIG. 1, a bloom 1 is rolled (by a rolling mill not shown) into a blank 2. This blank 2 is then rolled on a universal rolling mill by successive passages in one or more universal stands (first phase A) comprising two horizontal rolls 3 and 4 and two vertical rollers 5 and 6, and in one or more edger stands (second phase B) comprising two horizontal rolls 7 and 8, to be finished in a finishing stand (third phase C) comprising for instance two horizontal rolls 9 and 10 and generally a single vertical roller 11. During the phases of phase A, the horizontal rolls 3 and 4 exert a direct pressure on the web 12, the internal sides of the head 13 and the internal faces of the rail flange 14, whilst the vertical roller 5 exerts a direct pressure on the rolling tread of the head 13 and the vertical roller 6 exerts a direct pressure on the underside of flange 14. During the passes of the second phase B, the active parts of the horizontal rolls 7 and 8 exert a slight direct pressure on the sides of the head 13 and the ends of flange 14. During this second phase B, the relatively non-active parts of the rolls 7 and 8 which exert virtually no pressure on web 12 of the rail merely come into contact with web 12 or do not even touch it in most cases.

During the third phase called finishing C, the horizontal rolls 9 and 10 exert a direct pressure on the head 13, the web 12 and the internal lateral faces of flange 14; the vertical roller 11 exerts a direct pressure on the underside of flange 14. This third phase C is intended to give the finished shape of the rail. In an application of the universal rail rolling process with a reversing rolling mill, the grooves of the first phase A and second phase B are modified by screwdown of the horizontal rolls and vertical rollers between each pass. In an application with a continuous rolling mill in which one single pass is made in each stand, the grooves of the first and second phases A and B are specific and are not modified by screwing down, the settings of the horizontal rolls and the vertical rollers remaining fixed.

In the universal rail rolling process of French Pat. No. 1.447.939, such as applied by French Pat. No. 2.025.705, a second phase B′ is proposed as shown in FIG. 1. This phase B′ differs from phase B only by the arrangement, side by side as is usually done in conventional rolling with a two-high stand, of two separate and different grooves.

Figure 2:
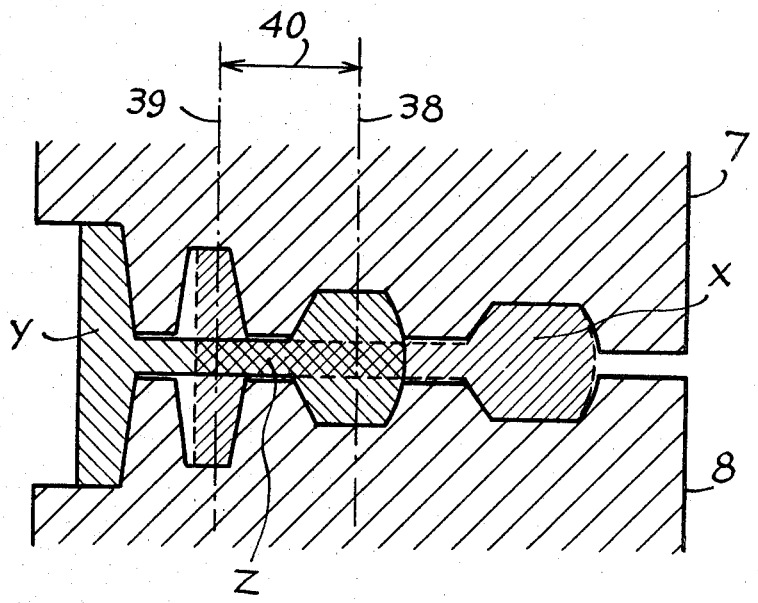
FIGS. 2, 3 and 11: illustrate the application of the invention to the rolling of rails by the universal process.
Figure 3:
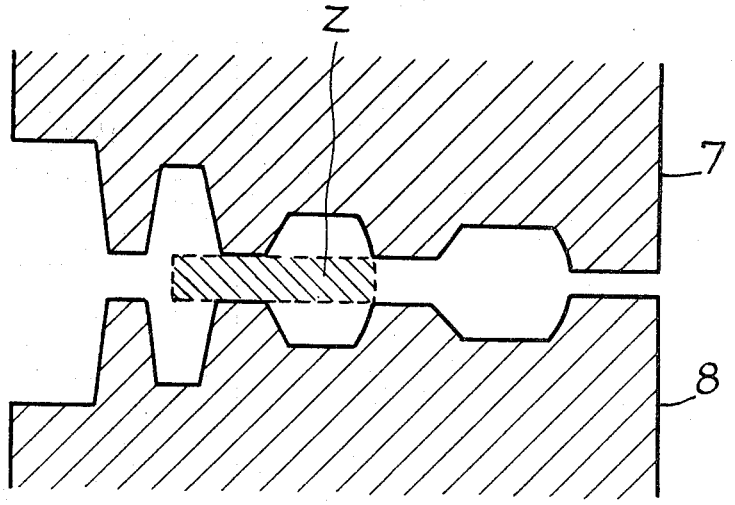

If it is taken into consideration:

on the one hand, that during the passes of the second phase B, that is to say edging passes, (FIG. 1) there is no pressure or virtually no pressure exerted on the web 12 by the rolls 7 and 8, on the other hand, that the pressure exerted by the rolls 7 and 8 on the other parts of the rail, that is to say, on the head 13 and the flange 14, is slight when compared with the pressures exerted by the rolls 3 and 4 and the rollers 5 and 6 during the passes of the first phase A, finally, that the passes of the second phase B are followed by passes of phase A and/or of phase C, so that any risk of malformation of web 12, which malformation can only be very minimal and without harmful consequences for the shape of the finished rail, is immediately and fully corrected by a phase A pass, (i.e. universal) or a pass of the third phase C (i.e. finishing):

it may be concluded that there is no need to be very much concerned about the web 12 of the rail during the phase B edging passes. Proceeding from this conclusion, the present invention consists of rendering common, for a plurality of edging passes, the portions of grooves surrounding the web 12 of a rail or more generally of any shape that can be rolled by a series of universal and edging passes, in making use, for a given pass of the part of groove surrounding the head 13 or the flange 14 of another pass, as illustrated in FIG. 2, in which are shown the grooves of two edging passes and the rail sections X and Y which are rolled there. The grooves in which the rail sections X and Y of two different edging passes are rolled one after the other comprise a common region Z hatched in full and dotted lines. For better understanding of the invention, FIG. 3 shows the grooves of the two edging passes without representation of the rail sections X and Y. The common region Z of groove is there indicated by hatching.

It must be understood that the invention is not of course limited to the overlapping of two grooves only. Depending on the shape of rolled rail and the locations of the edging passes in the rolling sequence, one can devise a plurality of edging passes for one same rail profile, or several separate groups of overlapped edging grooves for a same rail shape, or even groups of overlapped grooves and at least one separate groove, or even the overlapping of edging passes of different profiles of rail, and even the presence side by side of groups of overlapped passes of different rail profiles.

Further the invention is not limited to universal rail rolling and edging passes, but is also applicable to open passes of profiles having portions that are not subjected or virtually not subjected to pressures.

Figure 4:
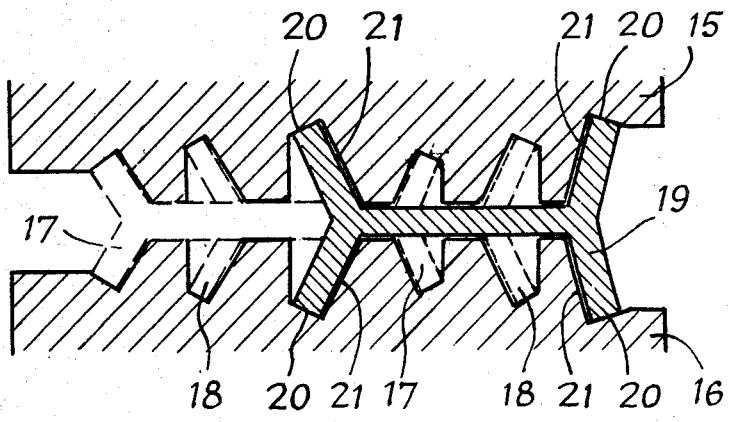
FIGS. 4 and 8: to the rolling of beams.

The invention can be applied, for instance, to edging passes of beams rolled on a universal rolling mill, as shown in FIG. 4, in which the horizontal edging rolls 15 and 16 comprise three specific overlapping edging grooves of a same beam. The reference 17 designates the section of the bar of the first edging pass, reference 18 designates the section of the bar of the second edging pass and reference 19 the one of the third edging pass.

FIG. 4 shows the edging pass of the flanges of the section of bar 17, during which the grooves of rolls 15 and 16 press the edges 20 of the flanges and come in contact, where necessary, with the internal faces 21 of the flanges and the web. This arrangement of the rolls 15 and 16 coming into contact, where necessary, with the internal faces 21 of the flanges and the web, make it possible to make the flanges symmetrical in relation to the longitudinal axis of the beam. This symmetry exists for the three passes represented. It is possible to obtain said symmetry with all the overlapping passes of the invention, whatever the number of passes, since the edging grooves are specific to each pass, and not common to all the edging passes as in a conventional reversing rolling mill on which the edging passes are made in a single groove by screwing down the rolls between each pass. It goes without saying, in applying this invention on a reversing rolling mill, that the rolls 15 and 16 must be screwed down at each edging pass, and therefore the rolls are designed so that they are at the nearest point of the web at each edging pass. The present invention can also be applied to a continuous rolling mill. In this latter case it is possible not to have to replace the rolls 15 and 16 at each rolling of a different profile of beam. The invention, in this case, makes it possible to overlap the edging passes of several different profiles, which obviates having to change the edging rolls at each change of profile. The invention also makes it possible, in the case of a continuous or reversing rolling mill, to have spare edging grooves to replace worn-out grooves, which also obviates the replacement of worn rolls by new rolls.

Figure 5:
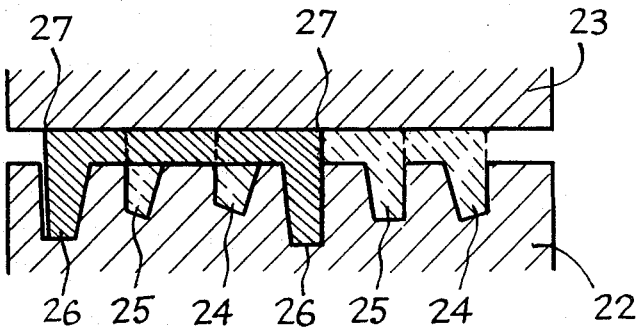
FIG. 5: to the rolling of channels.

The invention can also be applied to the edging of channels, as shown in FIG. 5, in which the rolls 22 and 23 comprise for instance three overlapping grooves, making it possible to edge the flanges 24 in a first pass, then the flanges 25 in a second pass and flanges 26 in a third pass. The invention in this case makes it possible to suppress rounding of the corners 27, a frequent defect of this profile when rolled on a universal rolling mill. It makes it possible, as for the beams, to makes the flanges of the channels symmetrical.

Figure 6:
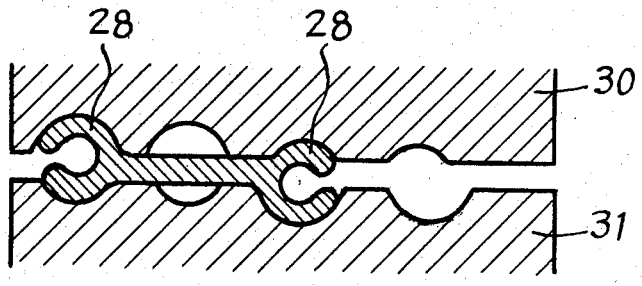
FIGS. 6 and 7: to the rolling of sheet piles.
Figure 7:
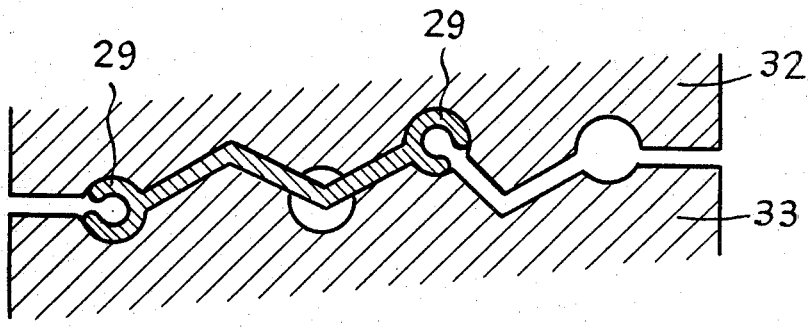

The invention can also apply to the rolling of sheet piles as shown in FIGS. 6 and 7, in which it may be used for closing the locks 28 and 29. FIGS. 6 and 7 show respectively a straight sheet pile and a sheet pile of Z shape. A single pass is represented on each figure, the groove of the other pass being empty. This second groove may be made for another size of sheet pile, or to serve as a spare groove, or serve for closing the locks in several passes with screw-down or not of the rolls 30 and 31 or 32 and 33.

Figure 8:
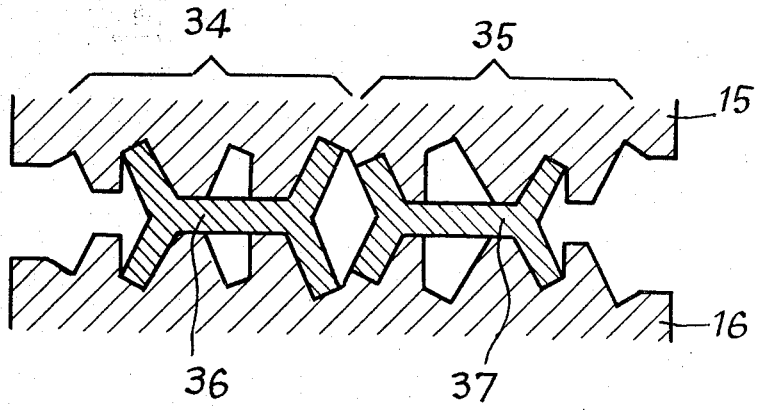

The overlapping of the grooves of the invention, must not be considered as being limited to two or three passes only. Depending on the rolled profiles, the dimensions of said shapes, the mixing or not of grooves of different profiles, and depending on the barrel length of the rolls, a plurality of groups of overlapping grooves can be provided, as shown in FIG. 8, where can be seen on the horizontal rolls 15 and 16, two groups 34 and 35 of overlapped grooves for the rolling of beams. This multiplicity of groups of overlapped grooves can be obtained with the other profiles of the types herein described. So as not to make the drawing unnecessarily complicated only two profiles of beams 36 and 37 have been shown belonging to different groups of distinct grooves. Groups 34 and 35, which here comprise only two overlapped grooves still for the same reasons of clarity, are not of course each limited to two grooves.

In the preferred application of the invention, the overlapping grooves, as well as the groups of overlapping grooves, are as close as possible, so that the longitudinal symmetrical planes of the grooves are the closest possible to the rolling line.

In FIG. 2 the lines 38 and 39 indicate respectively the planes which are perpendicular to the rolls and which contain the axes of the grooves of the profiles X and Y, it being understood that in the case of a shape such as a rail it is conventional to regard, as the axis of the groove, the line resulting from the intersection of the horizontal plane of rolling and of the vertical plane passing via the middle of the web of the profile. It is advantageous for one of the planes, for example the one corresponding to the line 38, to coincide with the longitudinal rolling plane containing the rolling line. After the passage of the rail in the groove X, the rail is introduced into the groove Y, to be rolled there, by moving laterally either the rolling line or the rolls 7 and 8. The spacing 40 of the two planes of the grooves shown by the lines 38 and 39 is small. For the UIC 60 rail profile, it is of about 75 millimeters. In this case, it is sufficient to move the rolling line by 75 millimeters, to transfer it from plane 38 to plane 39.

If one considers, for example for the rolling of rails, that edging rolls 7 and 8 (which may be located upstream or downstream of one or more universal stands) are generally located at a distance of about 3 to 4 meters from the universal stands, a rail may be deviated laterally by 75 millimeters over a travel of 3 or 4 meters, without problem.

Figure 9:
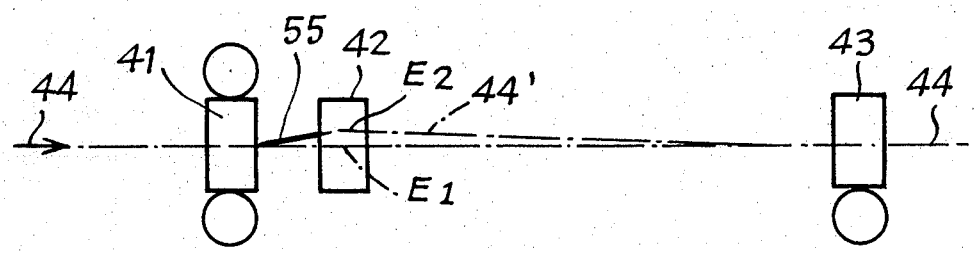
FIGS. 9, 10, 12 and 13: represent in diagrammatical plan the universal rolling of the rails on various layouts of reversing rolling mills and a continuous rolling mill.

The value of the lateral deviation of the rail with respect to the rolling axis 44 can be reduced for example by placing the edging grooves $E_1$ and $E_2$ of FIG. 9 on both sides of this axis 44. The deviation of the rail between the universal and edging stands, to change the edging groove, can be done very simply by means of a pivotal guiding switch, pivoted at its extremity away from the edging stand on a vertical axis which may be located in the longitudinal rolling plane. FIG. 9 shows diagrammatically, in plan, a universal reversing rolling mill for the rolling of rails, including a reversing universal stand 41, a reversing edger stand 42 and a nonreversing finishing stand 43. The upstream rolling mill serving for the breaking down of a bloom into a blank is not shown. The rolling line has the reference 44. If the blank enters the stand 41 in the direction of the arrow, several universal passes can be made in the stand 41 and several edging passes in stand 42 and a finishing pass in cage 43, the horizontal rolls and vertical rollers of stand 41 being screwed down at each pass while the horizontal rolls of cage 42 could, in the previous state of the art, be screwed down at each odd or even pass, and the cage 43 would not be screwed down. For example, if one is limited to a rolling sequence with 3 universal passes in the stand 41 in the previous state of the art with a non-shiftable edging stand 42 but with screwing down of the rolls, only the following distribution of passes could be obtained:

U1 E1 U2 U3 E2 F

In this distribution of passes and the following:

- U1, U2, U3 indicate universal passes done in a same groove, with screw-down after each pass (references not underlines),
- E1, E2, E3 etc. indicate edging passes made in non-specifice grooves adjusted by screw-down of the rolls (references not underlined),
- A herein underlined reference will indicate a pass made in a specific groove.
- F indicates the finishing phase, underlined because it is made in a specific groove.

By application of the present invention to a sequence with 3 universal passes, one can obtain with a single non-shiftable edger stand 42 (with or without screw-down) the following distribution of passes on a rolling mill of FIG. 9:

U1 E1 U2 U3 E2 F where

- E1 indicates a pass made in an edging groove exactly designed to follow the pass U1 (for example groove X of FIG. 2),
- E2 indicates a pass made in an edging groove exactly designed to follow the pass U3 (for example groove Y of FIG. 2).

The application of the present invention to a sequence with 5 universal passes on a rolling mill of FIG. 9 makes it possible to obtain the following distribution of passes, with a non-shiftable edger stand:

U1 E1 U2 U3 E2 U4 U5 E3 F

Figure 10:
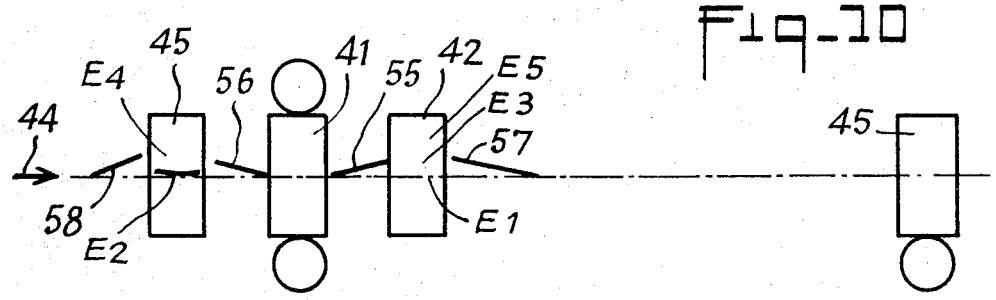

FIG. 10 represents diagrammatically, in plan, a universal reversing rolling mill like the one shown in FIG. 9, but having a second edger stand 45 placed upstream of the universal stand 41. By applying the present invention the following distribution of passes can be obtained:

(a) U1 E1 U2 E2 U3 E3 F if three universal passes are carried out on the universal stand 41, two passes E1 and E3 on the downstream edger stand 42 and one pass E2 on the upstream edger 45;

(b) U1 E1 U2 E2 U3 E3 U4 E4 U5 E5 F if five universal passes are made on stand 41.

Figure 11:
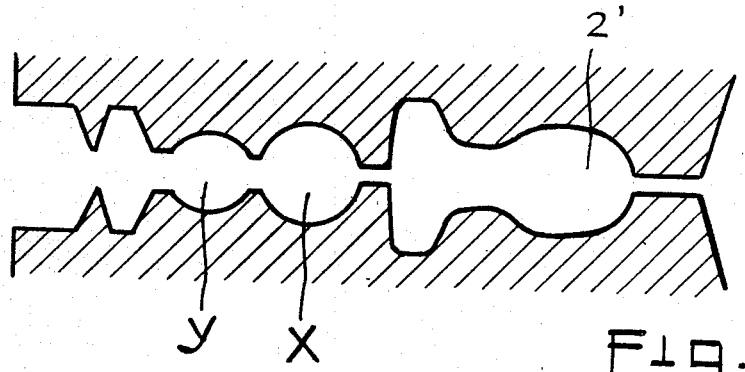

It will be observed for the distribution of passes of FIG. 10 that each universal pass is followed by a specific edging pass, which provides that this reversing rolling mill is the equivalent of a continuous rolling mill in respect of the edging passes:

(c) referring to FIG. 11, instead of making a dummy pass in passing the rail blank 2 into the stand 45 after raising of the rolls, the rolls of stand 45 can have a roughing groove 2' by the side of the overlapping specific edging grooves X and Y. This arrangement makes it possible either to compensate an inadequate barrel length of the roughing rolling mill more commonly called breakdown, or to provide for a spare 2' blanking groove, or a supplementary spare blanking groove.

Figure 12:
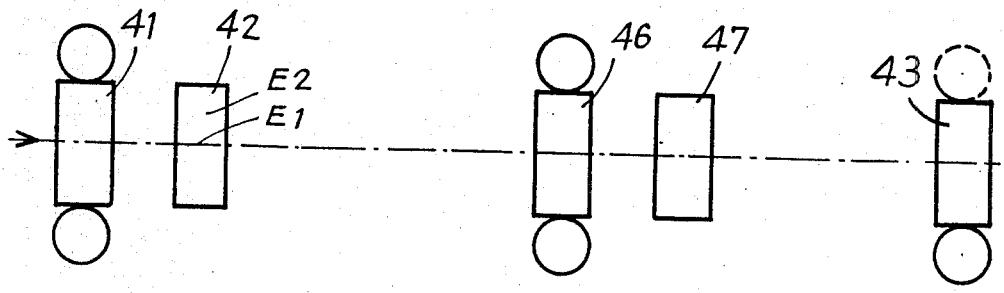

FIG. 12 represents diagrammatically, in plan, a universal reversing rolling mill with high production capacity comprising a reversing universal stand 41 and a reversing edger stand 42, a universal stand 46 and an edger stand 47, reversing or not, and a universal stand or semi-universal non-reversing finishing stand 43. By application of the present invention, by way of example the following distributions of passes can be obtained:

U1 E1 U2 U3 E2 U4 E3 F

Figure 13:
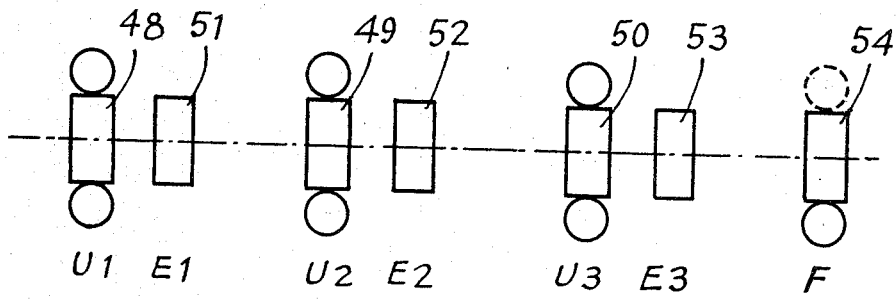

FIG. 13 represents diagrammatically, in plan, a universal continuous rolling mill comprising for instance three universal stands 48, 49 and 50, three edger stands 51, 52 and 53 and a universal or semi-universal finishing stand 54. The process is not of course limited to 3 groups of universal-edger stands and can be applied to a plurality of universal-edger groups. On a continuous rolling mill, as shown in FIG. 13, the distribution of the passes according to the previous state of the art is as follows:

U1 E1 U2 E2 U3 E3 F

The use of the present invention makes it possible, in this case, to have overlapping edging grooves which can offer several advantages on a continuous rolling mill. If, for example, a number of identical edging grooves are provided for on the rolls of stands 51, 52, 53 etc. (different grooves of course for each stand), it is possible to roll large tonnages from a common rail profile without having to change the rolls of stands 51, 52 and 53 etc. and/or to reduce the stock of edger rolls for a same rail profile. Provision can also be made on the rolls of edger stands 51, 52 and 53 etc. for the overlapping of the edging grooves of a plurality of different rail profiles, which makes it possible to roll different rail profiles by changing only the rolls of the universal stands 48, 49, 50 and of the finishing stand 54. It is also possible in the latter case to provide for spare edging grooves, and this further increases the advantages of using the invention. These advantages just described for a continuous rolling mill can also be found in the application of the invention to the reversing rolling mills of FIGS. 9, 10 and 12. The invention in fact gives to the reversing rolling mills the advantages of continuous rolling mills, in what regards the edger stands. The applications of the invention on rolling mills such as shown by FIGS. 9, 10, 12 and 13 are not limited to rails alone. They also concern the other profiles already mentioned.

The invention is not limited only to the overlapping of the edging grooves. It also concerns the rolling mill rolls, the processes and devices to feed the grooves, the stands equipped with rolls with overlapping grooves and the rolling mills comprising at least one such stand. Feeding with the rolled profile of overlapped grooves may be done in two ways, by deviation of the rolling line upstream and downstream of the overlapped grooves, or by side shifting of the overlapped grooves to make their axes coincide in turn with the rolling line, or even combining the two processes. When the deviation of the rolling line is not too great or, in other words, as long as the deformation which results therefrom for the rolled profile is acceptable, it is advantageous to deviate the rolling line by a device such as a guiding switch placed upstream and downstream from the stands comprising rolls on which are provided overlapped grooves of the present invention. For example, on a rolling mill such as shown in FIG. 9 on which are made only two specific overlapped edging passes E1 and E2, it is sufficient to have a single guiding switch 55 between the stands 41 and 42 to introduce the bar being rolled into the groove of pass E2 after the universal pass U3.

At the delivery side of the groove of pass E2 (that is to say downstream of the stand 42), a guiding switch system comprising as many guides as there are overlapped grooves can be provided. On a rolling mill such as shown in FIG. 10, it can be possible, for example, in a first variant, to have a single guiding switch 55 placed between the universal stand 41 and the edger stand 42. In a second variant, it will be necessary to have in addition a guiding switch 56 between the universal stand 41 and the upstream edger stand 45. In the first variant of FIG. 10, the guiding switch 55 has two positions. It serves to introduce the bar into the groove of pass E1, then, after the universal pass U3, to introduce the bar into the groove of pass E3. In the second variant of FIG. 10, the guiding switch 55 can have three positions. It serves to introduce the bar into the grooves of passes E1, E3 and E5. The guiding switch 56 placed between stands 41 and 45 introduces the bar into the grooves of passes E2 and E4 of the edger stand 45 placed upstream from the universal stand 41. A guiding switch 57 must always be provided downstream of the edger stand 42 to re-introduce the bar when required into the proper grooves of passes E1 and E3. A guiding switch 58 placed upstream of the stand 45 re-introduces the bar when required into the proper grooves. The same guiding switch is applicable to the rolling mills of FIG. 12 (semi-reversing and semi-continuous rolling mill) and if appropriate to rolling mills of FIG. 13 (continuous rolling mill). The setting of the guiding switches opposite the appropriate grooves can be manually controlled or can be programmed.

Figure 14:
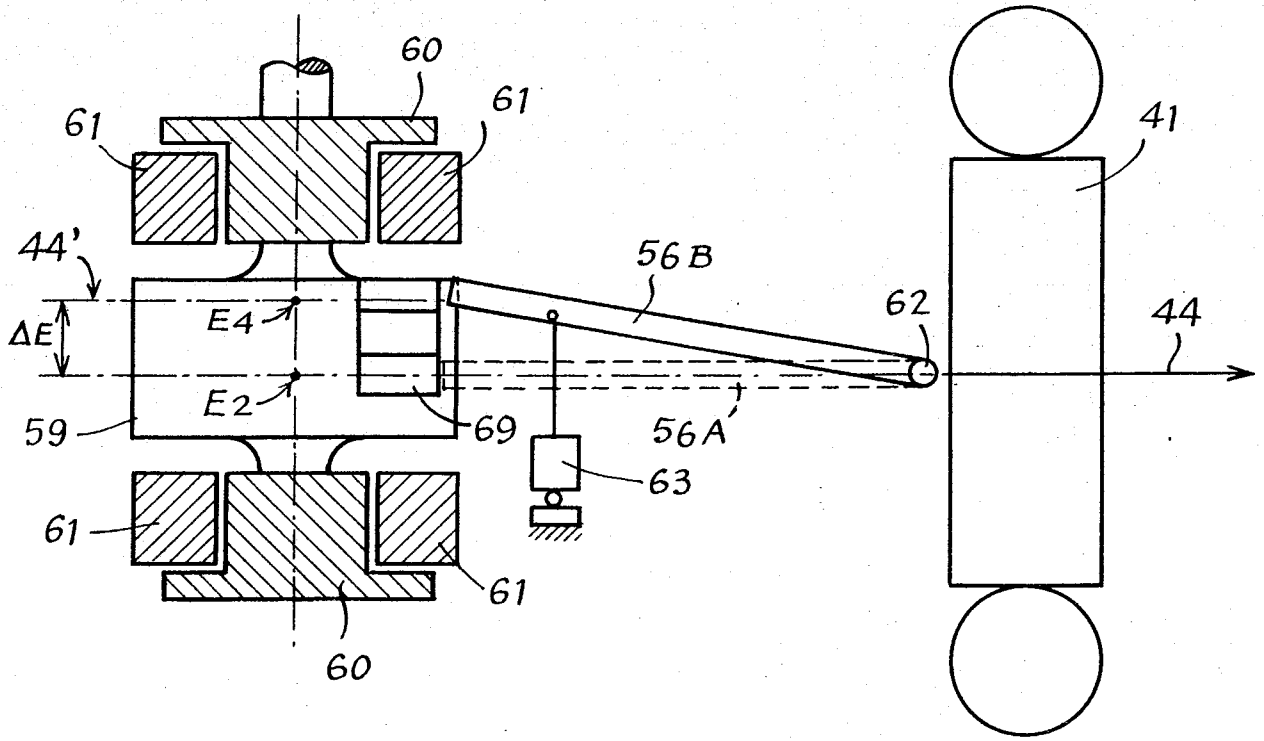
FIGS. 14, 15 and 16: represent diagrammatically devices to apply the invention.

The guiding switch system can be made as shown diagrammatically in FIG. 14 in which can be seen the guiding switch 56 of the second variant of FIG. 10, placed between the universal stand 41 and the edger stand 45. The universal stand 41 is represented symbolically. The edger stand 45 of FIG. 10 is shown diagrammatically, in plan section, with its lower roll 59, the chocks 60 of roll 59 and the columns 61 of the stand. The rolling line 44' of the groove of pass E4 is shown considerably spaced from the rolling line 44 of the rolling mill only for reasons of better illustration. In fact the distance ΔE between lines 44 and 44' is small, of the order of 75 mm for the UIC 60 rail profile, on average of 65 mm for the other rail profiles. The guiding switch 56 of FIG. 10 is shown in continuous lines in FIG. 14 by reference number 56B opposite the groove of pass E4. It can, for instance, be pivoted on a vertical axis 62 located near to the universal stand 41 and situated in the longitudinal rolling plane and be positioned by a hydraulic, pneumatic or electrical device 63 controlled for instance by the rolling mill computer. The position of the guiding switch opposite the groove of pass E2 is shown in broken lines by reference number 56A.

The distance ΔE can also be halved by dividing by half the displacement (deviation) of the guiding switch on both sides of the rolling line 44.

In some cases, and more particularly with a view to avoiding any risk of damaging the roll grooves, it is advantageous to provide for intermediate guides 69 between the guiding switch 56 and said grooves.

The change of the overlapped grooves can also be made without deviation from the rolling line 44 of the rolling mill by shifting the horizontal rolls. It is possible to arrange on the fixed parts of an edger stand transverse displacement jacks capable of acting, in relation to the fixed parts of the stand, on parts of the stand which are made movable.

Figure 15:
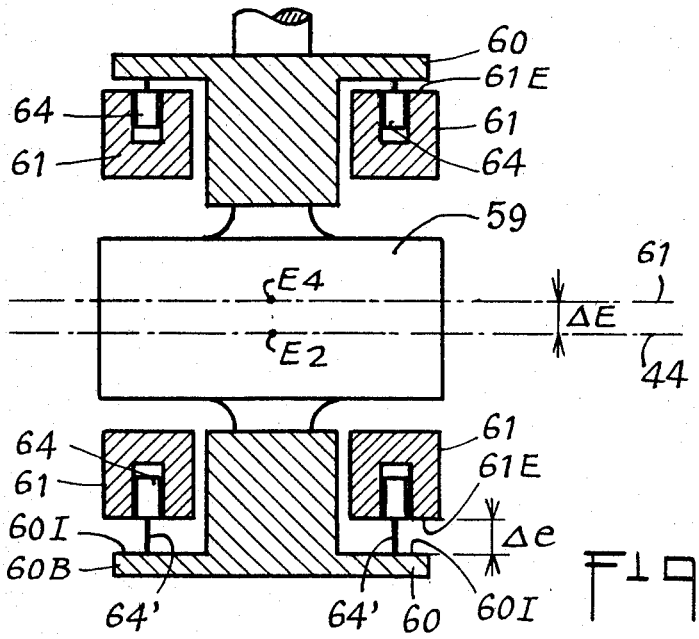
Figure 16:
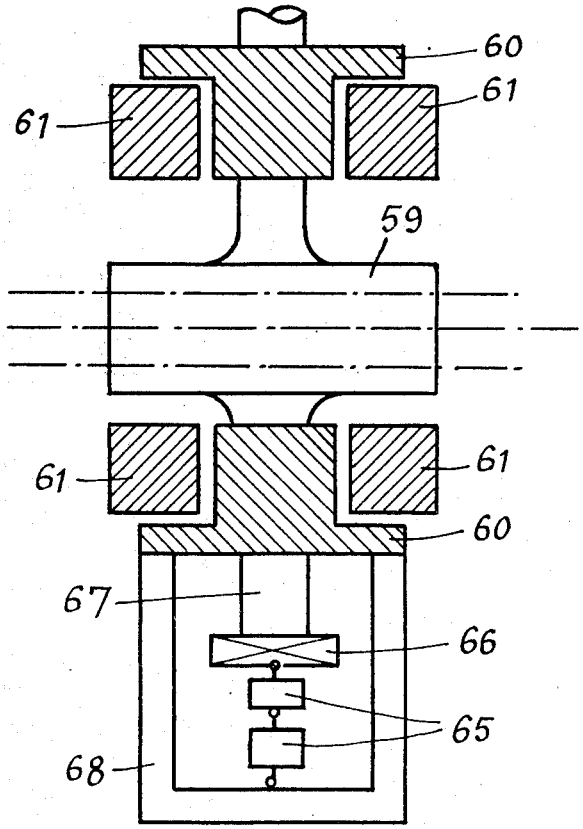

FIG. 15 again represents the edger stand 45 of FIG. 10. The lower roll 59 represented, just like the upper one (not shown) can be moved transversely over the distance ΔE by devices such as jacks 64 located in the columns 61 of the stand (or resting on them), these jacks acting on the chocks 60 which include a collar 60B whose internal surface 60I faces a part 61E of the external surface of columns 61 of the stand and also supports the rods 64' of jacks 64. The rolls can also be moved as shown in FIG. 16 by means of jacks 65 with multiple positions connected on one side by a coupling block 66 fixed at the necks 67 of the horizontal rolls. The necks slide within the chocks and can project from them at one side by at least the length separating the axes of the most distant grooves. FIG. 16 shows the fixing of coupling block 66 on the lower horizontal roll 59, and, on the other side, the jacks rest on a brace 68 fixed on one side of the stand on the chocks 60, the latter being themselves fixed to the columns 61. The brace may also be fixed directly on the columns 61 of the stand housing.

It is also possible to provide in a rolling mill for one or more edger stands to be shiftable transversely in relation to the rolling line; it can even be advantageous to combine, for at least one edger stand, the transverse shifting of the rolls in relation to the stand housing with the shifting of the stand in relation to the rolling line, i.e. a guiding switch arrangement.

It should be understood that the invention is not limited to the embodiments herein described and that the latter have been given by way of examples. The invention can be applied to edger stands of a universal rolling mill (edger stands comprising two horizontal rolls, with possibly one or two vertical rollers) as well as to two-high or three-high stands of a conventional rolling mill.

What is claimed is:

1. The improvement in the process of rolling rails from rail blanks with a plurality of universal and edging rolling passes and a single finishing pass according to a given pass distribution, made with a rolling mill having a layout designed to provide the given pass distribution and comprising a finishing stand and at least a universal-edger group comprising at least a universal stand having four rolls that are grooved and set to provide a single universal pass-line irrespective of the amount of passes made therein and at least an edger stand having at least two horizontal rolls, with all stands of said group being arranged on a straightaway line and being operated in tandem, that is with the rail blank being simultaneously contacted for a period by the rolls of all stands of said groups and with all driven rolls of any said stands being rotated in the same direction, wherein at least one said group comprises at least one edger stand, the rolls of which have their barrel length grooved to provide a plurality of specific edging grooves having each a plurality of active deep cavity portions and a bridging non-active shallow portion, said specific edging grooves having parallel but separate edging pass-lines, wherein guides located between each stand of the universal-edger groups direct the rail blank within the group from the pass-line of a stand into the pass-line of another stand, wherein the improvement comprises the steps of:

(a) introducing the rail blank in at least a universal stand of each universal-edger group, along the single universal pass-line of the universal stand; and (b) deviating the rail blank transversely, when appropriate, from the single universal pass-line downstream of the universal stand; and (c) guiding the rail blank towards an edger stand operated in tandem with the universal stand to introduce the rail blank into an overlapped edging groove of a plurality of overlapped edging grooves that are all made to overlap in order to have in common a part of their bridging non-active shallow portion, said plurality of overlapped edging grooves being located on the barrel length of the rolls of the edger stand so that the edging pass-line of at least one overlapped edging groove is transversely offset with respect to the universal pass-line; and (d) deviating the rail blank transversely, when appropriate, downstream of the edger stand; and (e) guiding the rail blank towards and into the single universal pass-line of the next-to-roll universal stand; and (f) repeating steps (a) to (e) hereinabove as required to provide the given pass distribution until before two passes ahead of the finishing pass, then repeating steps (a) to (d); and (i) guiding the rail blank towards the finishing stand, into the finishing pass-line to finally finish-roll the rail blank into a rail.

2. The process of rolling rails as set forth in claim 1 including:

(g) reversing the direction of rotation of all driven rolls of at least a universal-edger group after the rail blank has passed the last stand of said universal-edger group; and (h) repeating steps (a) to (g) as required to provide the given pass distribution, said distribution comprising rolling passes interspersed with at least a dummy pass made in at least one edger stand.

3. An improved rolling mill for rolling rails from rail blanks including a finishing stand and at least a universal edger group, each group comprising at least a universal stand having four rolls grooved and set to provide a single universal pass-line irrespective of the number of passes made therein and at least an edger stand having at least two horizontal rolls with the rolls of at least an edger stand being grooved and set to provide a plurality of specific edging grooves, each said groove having a plurality of active deep cavity portions and a bridging non-active shallow portion, said specific edging grooves having parallel but separate edging pass-lines, wherein all stands within any universal edger group are arranged on a straightaway line and are operated in tandem, that is with rail blanks being simultaneously contacted for a period by the rolls of all stands of said universal-edger group and with all driven rolls of said stands being rotated in the same direction, said rolling mill including guides located between each stand of each universal-edger group to direct the rail blank within each universal-edger group from the pass-line of a stand into the pass-line of a downstream stand and including guides located upstream and downstream of each universal-edger group to direct the rail blanks into and out of respectively the entry and delivery sides of each universal-edger group and of the finishing stand wherein the improved rolling mill comprises:

at least an edger stand, the rolls of which are grooved and set to provide a plurality of specific overlapped edging grooves having in common in an overlapped relationship a part of their bridging non-active shallow portions, with the pass-line of at least one overlapped edging groove being transversely offset with respect to the single universal pass-line of at least a universal stand of the same universal-edger group as said edger stand; and first means to deviate laterally the rail blanks delivered along the single pass-line of at least a universal stand, towards an offset pass-line of an overlapped edging groove; and second means to take over and to guide the deviated rail blanks into the offset pass-line of an overlapped edging groove; and third means to deviate laterally the rail blanks delivered along the offset pass-line of an overlapped edging groove towards the next single pass-line of a next-to-roll stand.

4. The improved rolling mill according to claim 3 comprising:

a guiding switch located between at least a universal and an edger stand of at least a universal-edger group, to perform the functions of the first and second means; and actuating means connected to the guiding switch to actuate it laterally.

5. The improved rolling mill according to claim 4 comprising:

a laterally pivotable guiding switch; and a vertical axis located at the end of the pivotable switch that is furthest from an edger stand, the pivotable guiding switch being pivotally connected to the vertical axis; and actuating means connected to the end of the pivotable switch that is closest to an edger stand, to make the pivotable guiding switch pivot laterally around the vertical axis.

* * * * *

UNITED STATES PATENT AND TRADEMARK OFFICE

CERTIFICATE OF CORRECTION

PATENT NO. : 4,370,877

DATED : February 1, 1983

INVENTOR(S) : Jacques M. Michaux

It is certified that error appears in the above-identified patent and that said Letters Patent are hereby corrected as shown below:

Column 7, line 17 "U1 E1 U2 U3 E2 F" should read --U1 E1 U2 U3 E2 F--

Column 7, line 36 "U1 E1 U2 U3 E2 F" should read --U1 E1 U2 U3 E2 F--

Column 7, line 58 after pass "E2" should be --E2--

Signed and Sealed this

Twenty-sixth Day of April 1983

[SEAL]

Attest:

GERALD J. MOSSINGHOFF

Attesting Officer

Commissioner of Patents and Trademarks